US006964183B2

(12) United States Patent
Keightley

(10) Patent No.: US 6,964,183 B2
(45) Date of Patent: Nov. 15, 2005

(54) DUAL LOCK APPARATUS

(76) Inventor: Kym John Keightley, 5 Vincenzo Street, Fairview Park, South Australia (AU), 5126

( * ) Notice: Subject to any disclaimer, the term of this patent is extended or adjusted under 35 U.S.C. 154(b) by 0 days.

(21) Appl. No.: 10/276,574

(22) PCT Filed: May 18, 2001

(86) PCT No.: PCT/AU01/00579

§ 371 (c)(1),
(2), (4) Date: Nov. 14, 2002

(87) PCT Pub. No.: WO01/88315

PCT Pub. Date: Nov. 22, 2001

(65) Prior Publication Data

US 2003/0106357 A1 Jun. 12, 2003

(30) Foreign Application Priority Data

May 18, 2000 (AU) ..... PQ7576

(51) Int. Cl.[7] ..... E05B 47/00
(52) U.S. Cl. ..... 70/279.1; 70/278.2; 70/280
(58) Field of Search ..... 70/279.1, 278.2, 70/278.3, 278.7, 280, 93, 104, 106, 129, 134; 292/165, 172, 142, 144

(56) References Cited

U.S. PATENT DOCUMENTS

| | | | | |
|---|---|---|---|---|
| 4,156,541 A | | 5/1979 | Babb, Jr. et al. | 292/21 |
| 5,083,448 A | * | 1/1992 | Karkkainen et al. | 70/277 |
| 5,199,288 A | * | 4/1993 | Merilainen et al. | 70/279.1 |
| 5,626,039 A | | 5/1997 | Solari et al. | 70/279 |
| 5,707,090 A | * | 1/1998 | Sedley | 292/172 |
| 5,857,365 A | * | 1/1999 | Armstrong | 70/279.1 |
| 6,038,896 A | * | 3/2000 | Chamberlain et al. | 70/279.1 |
| 6,116,067 A | | 9/2000 | Myers et al. | 70/279.1 |
| 6,250,119 B1 | * | 6/2001 | Flon | 70/279.1 |
| 6,318,138 B1 | * | 11/2001 | Mathews et al. | 70/278.7 |
| 6,581,426 B2 | * | 6/2003 | Bates et al. | 70/278.7 |
| 2001/0029760 A1 | * | 10/2001 | Viney | 70/279.1 |

FOREIGN PATENT DOCUMENTS

| | | |
|---|---|---|
| EP | 0 482 786 A1 | 10/1991 |
| GB | 2 307 270 | 11/1995 |
| WO | WO 91/00405 | 6/1990 |

* cited by examiner

*Primary Examiner*—John B. Walsh
(74) *Attorney, Agent, or Firm*—Sand & Sebolt

(57) ABSTRACT

The present invention relates to a lock arrangement having a lock (14) and including a first locking device (52) adapted to operate the lock to lock and unlock the lock. A second locking device (68) includes a member (32) moveable between a first and a second position wherein when the member (32) is in the first position the lock is locked and when in the second position the lock is unlocked. Generally the first locking device (52) is key operated and the second locking device (68) is driven by an electric motor (72). The first locking device (52) can operate the lock independently of the member (32) and regardless of its position and when used to lock or unlock the lock can decouple through a clutch mechanism (80) the second locking device (68) from controlling the lock.

11 Claims, 18 Drawing Sheets

DUAL LOCK APPARATUS

The present invention relates to a dual lock apparatus and in particular to a dual lock apparatus that has at least two independent means of acting on a lock.

BACKGROUND OF THE INVENTION

There are numerous types of locks in existence today that are used to secure various devices. One of the more common uses of locks is in relation to doors. Typically door locks have a bolt that can be extended from a locking mechanism so as to engage a doorframe or furniture with the bolts being driven by the use of a unique or slave key. There have also been developed locks that are not only operable by the use of the slave key but also a master key, allowing the master key holder, for example, to operate all doors in a pre-defined area whilst the slave key holders are limited to being able to operate specific doors only. This however requires the master key and the slave key to be of the same type thus potentially comprising security.

There have also been developed electromechanical locks that use an electric motor to drive the bolt. The difficulty with these type of arrangements is that if the electric motor was for whatever reason inoperable, the door may be left either in the unlocked or locked state and may require disassembly to be fixed.

Further still, the difficulty with some existing locks is that although the door may be unlocked, that is it may be opened, the bolt still engages a portion of the door frame and further manual operation of the bolt by the use of a handle is required to be able to open the door. On the other hand, if the bolt was to be retracted fully, then the door may swing freely, also an undesirable effect.

It is an object of the present invention to propose a locking apparatus that overcomes at least some of the abovementioned problems or provides the public with a useful alternative.

Although the present specification discusses doors in particular it is to be understood that the present invention is not intended to be limited to doors and may equally well be used to provide a locking means in relation to other devices such as safes and gates to name but two.

SUMMARY OF THE INVENTION

Therefore in one form of the invention there is proposed a lock arrangement having a lock and including:

a slider including a body and an arm, said body operatively coupled to a bolt that locks and unlocks said lock; a first drive means adapted to engage said slider body and move said slider between at least a first and a second position, said lock locked when the slider is in said first position and unlocked when said slider is in said second position; a second drive means adapted to engage said arm via a demountable rack and move said slider between at least said first and second positions when said demountable rack is mounted to said slider arm; wherein when said first drive means engages said slider body, said rack is caused to demount from said slider arm.

In a further form of the invention there is proposed a lock including:

a first drive means and a second drive means; a slider which when in a first position locks said lock and when in a second position unlocks said lock; said first drive means and second drive means each adapted to move said slider from the first position to the second position and from the second position to the first position, wherein operation of said first drive means to move said slider from the first to the second position causes said slider to disconnect from said second drive means, and whereby subsequent operation of said second drive means that would otherwise move the slider to the second position re-connects said second drive means and the slider to enable said second drive means to operate the lock.

In a still further form of the invention there is proposed a lock including:

A first drive means and a second drive means; a slider which when in a first position locks said lock and when in a second position unlocks said lock, said slider including at least two separable parts; wherein said slider is adapted to be acted on by said first and second drive means, wherein when said slider is acted upon by said second drive means said slider parts are cooperatively engaged to lock or unlock said lock; and wherein when said slider is acted upon by said first drive means said slider separable parts are decoupled allowing said first drive means to engage said slider independent of said second drive means that then no longer operates said lock.

Preferably when said first drive means has locked said lock, said second drive means cannot unlock said lock.

In a further preferred embodiment the second drive means can reengage said slider to operate the lock.

Preferably, the first drive means is key operated. Advantageously, the second drive means is electrically operated. Advantageously, the second drive means is key operated.

In a yet further form of the invention there is proposed a lock arrangement including:

a casing and a locking bolt slidably supported by said casing and movable between at least first and second positions, in said first position extending outwardly from said casing to engage with an external restraining means and in said second position to be contained within said casing; a slider located within the casing and adapted to interact with said locking bolt so as to move it into said first or second position; said slider including at least a two-dimensional cavity defined at one side by an abutment surface and on the other side by a gate; a first activation unit rotatably supported by said casing and having a cam adapted to rotate into said cavity; said cam when rotated in a first direction acting against the slider abutment surface and urging the slider towards a first position and thereby outwardly extending said bolt and when said cam is rotated in an opposite direction it engages said slider gate to urge the slider towards a second position to thereby inwardly retract said bolt; said cam able to enter said cavity independent of the position of said slider by said gate allowing said cam to enter said cavity through said gate but not to exit it until the slider has been moved sufficiently towards its second position where the path swept by said cam does not intersect said gate; and a second activation unit adapted to move the slider between its first and second positions.

Thus one can appreciate that in the case of keyed locks there may be master and a slave key that operate a first and a second drive means respectively. The master key operates the first drive means and can lock or unlock the lock independent of the secondary drive means. However, if the master key has locked the lock, the slave key that operates the second drive means is unable to either lock or unlock the lock. Only if the first drive means has not locked the lock can the slave key lock or unlock the lock.

This provides a significant advantage where the use of a master key in conjunction with a slave key enables one that has a master key to control whether others that have slave keys can in fact operate a particular lock.

In addition, the above provides the advantage that if the secondary locking mechanism is one that may be exposed to potential failure, the primary locking means ensures that there is a safeguard in that the lock can always be operated even if the secondary locking means has ceased to function.

Advantageously said first drive means may be a key activated locking means whilst said second drive means may be an electromechanical drive means.

A particularly apt use of this invention is in the case where the electromechanical drive means is controlled by remote activation of an electric motor. If for whatever reason the electric motor were to fail, such as a power failure, then the primary drive mechanism that is operated for example by a key may be used to unlock or lock the lock.

It is preferred that said second activation unit includes an electric motor that engages said slider by a rack having a slit and a recess, the mechanical coupling of the slider with the rack achieved by a plunger fixedly attached to said slider and having a projection correspondingly dimensioned to said recess, said plunger movable between a first and a second position, in a said first position said projection engaging with said recess to thereby effectively mechanically couple said second activation unit to said slider and thus the bolt and in said second position said projection enters the slit within which it may slidably move to thereby effectively decouple said second activation unit to the slider.

BRIEF DESCRIPTION OF THE DRAWINGS

The accompanying drawings, which are incorporated in and constitute a part of this specification, illustrate several implementations or embodiments of the invention and, together with the description, serve to explain the advantages and principles of the invention. In the drawings.

DESCRIPTION OF THE PREFERRED EMBODIMENTS

The following detailed description of the invention refers to the accompanying drawings. Although the description includes exemplary embodiments, other embodiments are possible, and changes may be made to the embodiments described without departing from the spirit and scope of the invention. Wherever possible, the same reference numbers will be used throughout the drawings and the following description to refer to the same and like parts.

The present invention relates to locks and in particular to locks that are used for hollow winged aluminium doors and the like. It may also be adapted to be used on other type of doors such as sliding doors. It is not intended to limit the invention to any particular type of lock or door.

Figure 1:
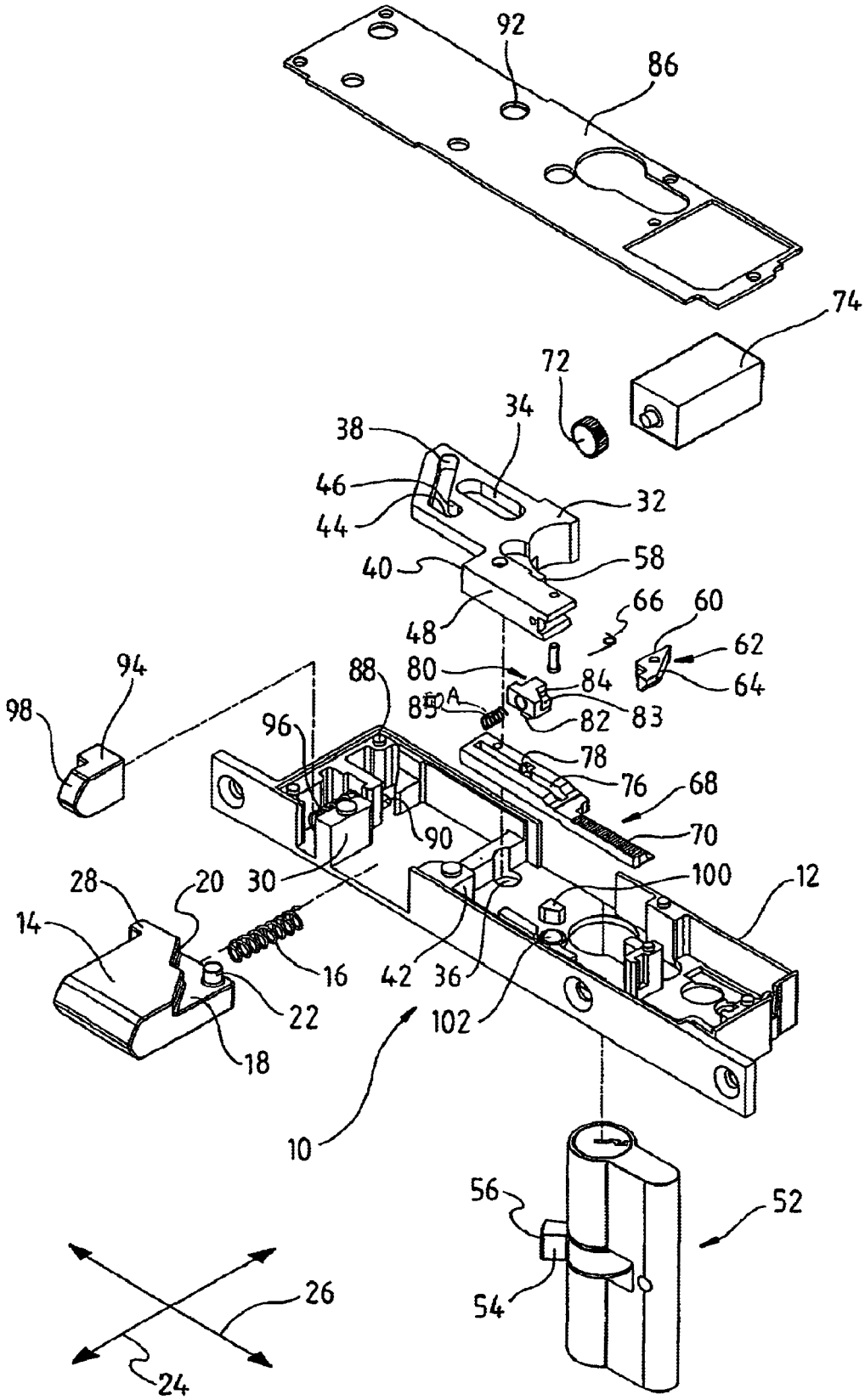
FIG. 1 is an exploded view of the different components of a lock according to a first embodiment of the present invention.
Figure 2:
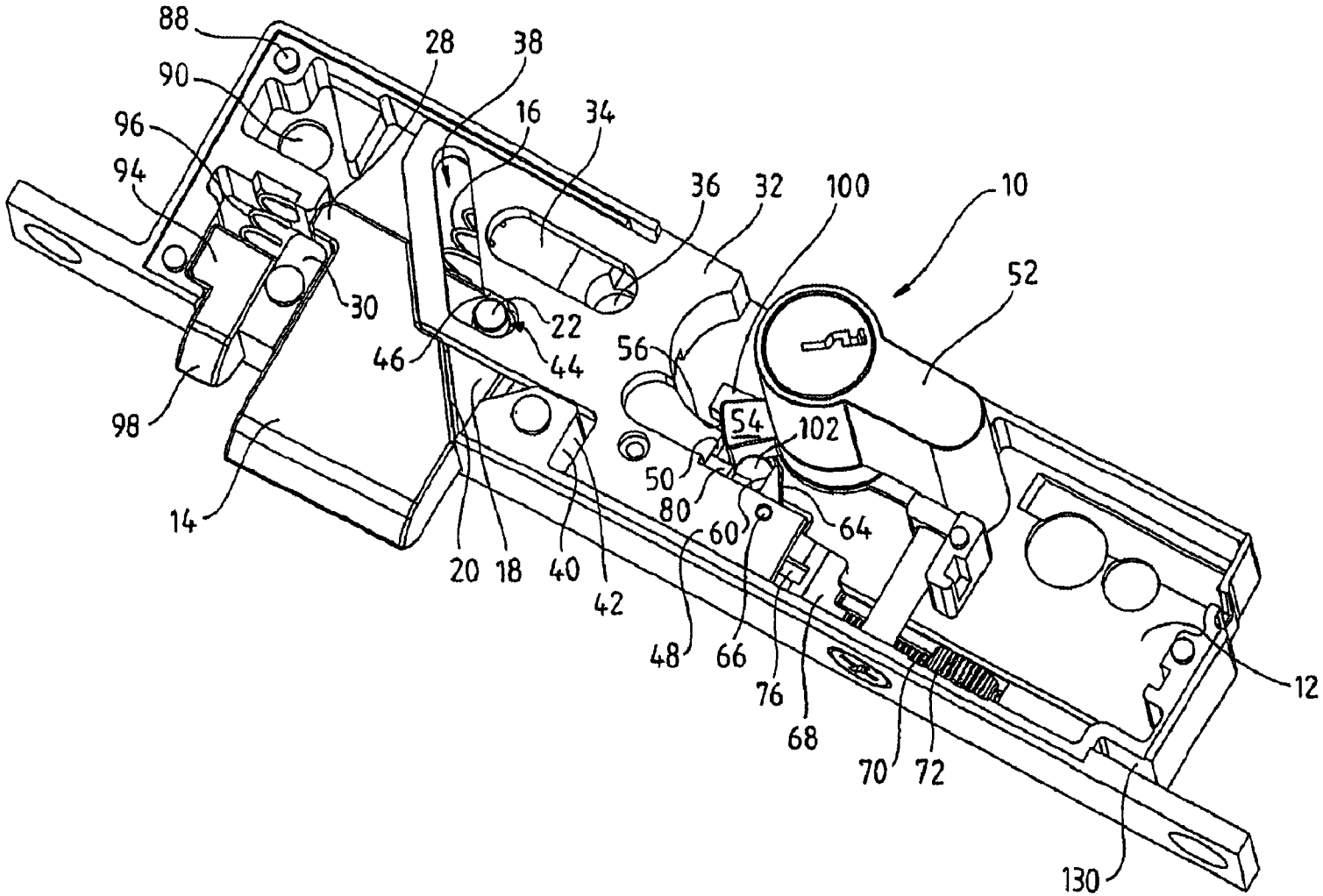
FIG. 2 is a perspective view of the internal components of the lock of FIG. 1.

Shown in FIGS. 1 and 2 is a lock 10 according to a first embodiment of the present invention. A casing 12 is adapted to slidingly support a locking bolt 14 said bolt being biased outwardly from said casing by the use of spring 16. The bolt 14 includes a sunken shoulder 18 at one side of the bolt rear end and defined by an external face 20, said shoulder supporting an annular projection 22. The bolt is adapted to slide generally in a perpendicular axis 24 to the longitudinal axis 26 of the casing 12. A projection 28 on the rear end of said bolt 14 situated opposite said shoulder 18 engages boss 30 to limit the outward movement of said bolt.

A slider 32 is adapted to slide along the longitudinal direction 26 within the casing 12 and includes a first longitudinal slit 34 engaging a screw (not shown) passing through aperture 36, the screw providing holding support for said lock.

The slider 32 includes a second slit 38 extending at an inclined direction to both the perpendicular and the longitudinal axis 24 and 26 respectively. Slit 38 engages projection 22 of the shoulder 18. One can thus appreciate that when the slider is moved towards the bolt, the inclination of the slit 38 causes the bolt to be extended outwardly from said casing. Conversely when the slider 32 is moved in a direction away from the bolt, the slit 38 acting on the shoulder projection 22 urges the bolt to be withdrawn into the casing.

The slider may further include a shoulder 40 adapted to abut against face 42 in the casing to act as a dead stop for the slider motion.

The end of the slit 38 where the bolt is caused to extend out of said casing includes a hooked portion 44 where the slit extends in a longitudinal direction parallel to the casing and thus perpendicular to the movement of the bolt. This has the advantage that when the projection 22 is located within the hooked location, the slider effectively deadbolts the bolt. That is, if the bolt experiences an inward force, the edge 46 of the hooked portion of the slit engages the projection 22 and prevents the bolt from moving into the casing. To keep the projection steady within the hooked portion the slit may include a slight annular recess.

It is the slider that provides the motion for the movement of the bolt into and outward of the casing. To enable the slider to be movable by both a primary and a secondary locking mechanisms requires a clutch mechanism that is now described.

The slider further includes an arm 48 and an abutment surface 50 located at the beginning of the arm. A lock barrel or cylinder 52 rotatably fixed to the casing includes a cam 54 that upon rotation of the key barrel is caused to abut against surface 50 and provide an urging longitudinal force on the slider that in turn drives the bolt outwardly from the casing. With continued rotation of the lock barrel, the cam slides across the abutment surface 50 until the bolt is in the extended and deadlocked position whereupon the outer face 56 of the cam abuts the corner 58 of the slider. This provides a deadlocking feature in that any forced motion of the slider so as to withdraw the bolt will be resisted by the cam.

To unlock the bolt, the cam is rotated back whereupon it abuts against inner surface 60 of gate 62, which is fixed to the arm of the slider. Thus the force exerted by the cam on the gate causes the withdrawal of the slider and thus the bolt. The gate is however inwardly rotatable with respect to the arm, that is, it may be rotated so that the gate is rotated towards the abutment surface 50. This feature is necessary so that when the slider is in the locked position and the cam has not engaged the slider, the cam can be rotated into contact with the abutment surface 50. As the cam is rotated it comes into contact with the outer face of the gate. Further rotation of the cam causes the gate to be rotated inwardly towards the abutment surface until the cam is able to move past the gate. The gate outer surface for that reason needs to be an inclined surface.

The gate includes a biasing means such as spring 66 that normally keeps the gate in the upward position. Thus when the cam has moved past the gate, it springs back into its resting or biased position.

The slider may also be moved by the use of a secondary locking means including a rack 68 that is adapted to engage the slider. The rack includes at one end splines 70 that are driven by a gear 72 rotatably driven by an electric motor 74. The other end of the rack includes a slot 76 having an upper cutout or recess 78 located generally halfway along the slot.

A plunger 80 provides for the mechanical coupling between the slider and the rack. The plunger 80 is fixedly attached to the slider arm and includes a projection 82 that is correspondingly dimensioned to the cutout 78. The plunger is located between the abutment surface 58 and the gate 62 and so dimensioned to protrude beyond the width of the arm 48. The plunger includes a biasing means, such as spring 85, that biases the plunger away from said arm. In the biased state the plunger projection engages the cutout or recess. Thus, the rack and the slider are mechanically coupled to each other when the projection engages the cutout in the rack.

To accommodate the gate rotating inwardly the plunger includes a detent 83 that is appropriately shaped to accommodate the gate rotating inwardly.

When movement of the cam has depressed the plunger, the projection disengages the cutout and enters the slot within which it may freely move. Thus one can appreciate that when this has occurred the slider and the rack may move independently of each other along the length of the rack slot. So that the cam may depress the plunger it includes an inclined surface 132 where the cam connects with the plunger.

As mentioned above it is the cam 54 that causes the depression of the plunger. Thus whenever the cam is rotated either to engage the abutment surface of the slider 50 or the gate outer surface 64, the plunger is depressed causing disengagement of the rack and the slider.

A side cover 86 neatly encloses the above described components within the casing, the side cover being held in place by the use of studs 88 on the casing and screws (not shown) passing through various co-axial apertures such as 90 in the casing and 92 in the cover.

So as to keep the door from freely swinging when in the unlocked position, the lock mechanism may include a spring-loaded latch 94 being outwardly biased by spring 96. The latch includes tapered surfaces 98 that enable the latch to be urged inwardly when a sideways force is applied to the latch and thus the door.

When the primary locking mechanism, in this case the key activated lock, is in the deadlocked position, as illustrated in FIG. 2, the cam is prevented from further rotation by detent 100 and is frictionally held from rotating backwards by the use of a spring loaded bearing 102. The bearing will not prevent the cam from being acted upon by the key. Rather it is intended that the bearing will cause enough of a frictional engagement so that either under gravity or external shaking of the lock arrangement the cam will not rotate downwards.

Figure 3:
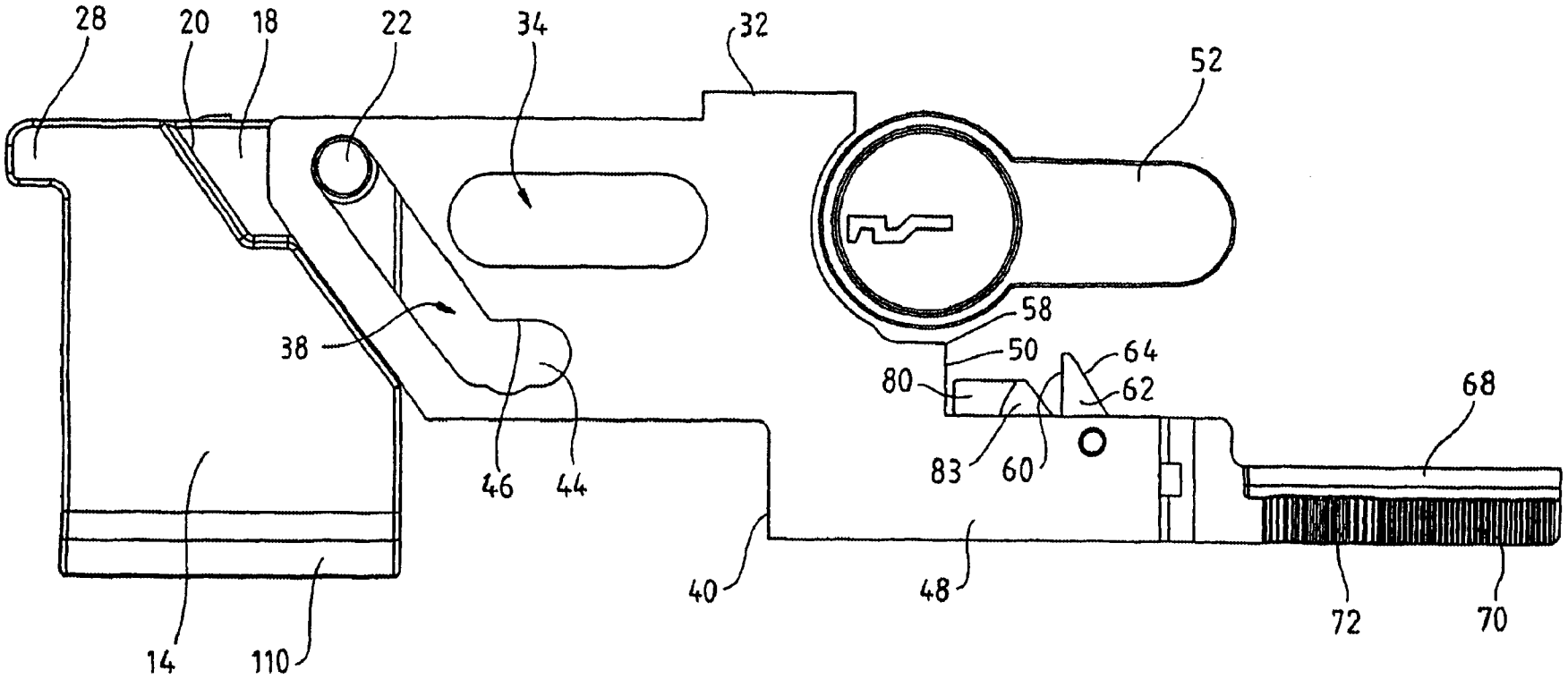
FIG. 3 is a cross-sectional view of the main component of the lock according to the present invention when in an unlocked position.
Figure 4:
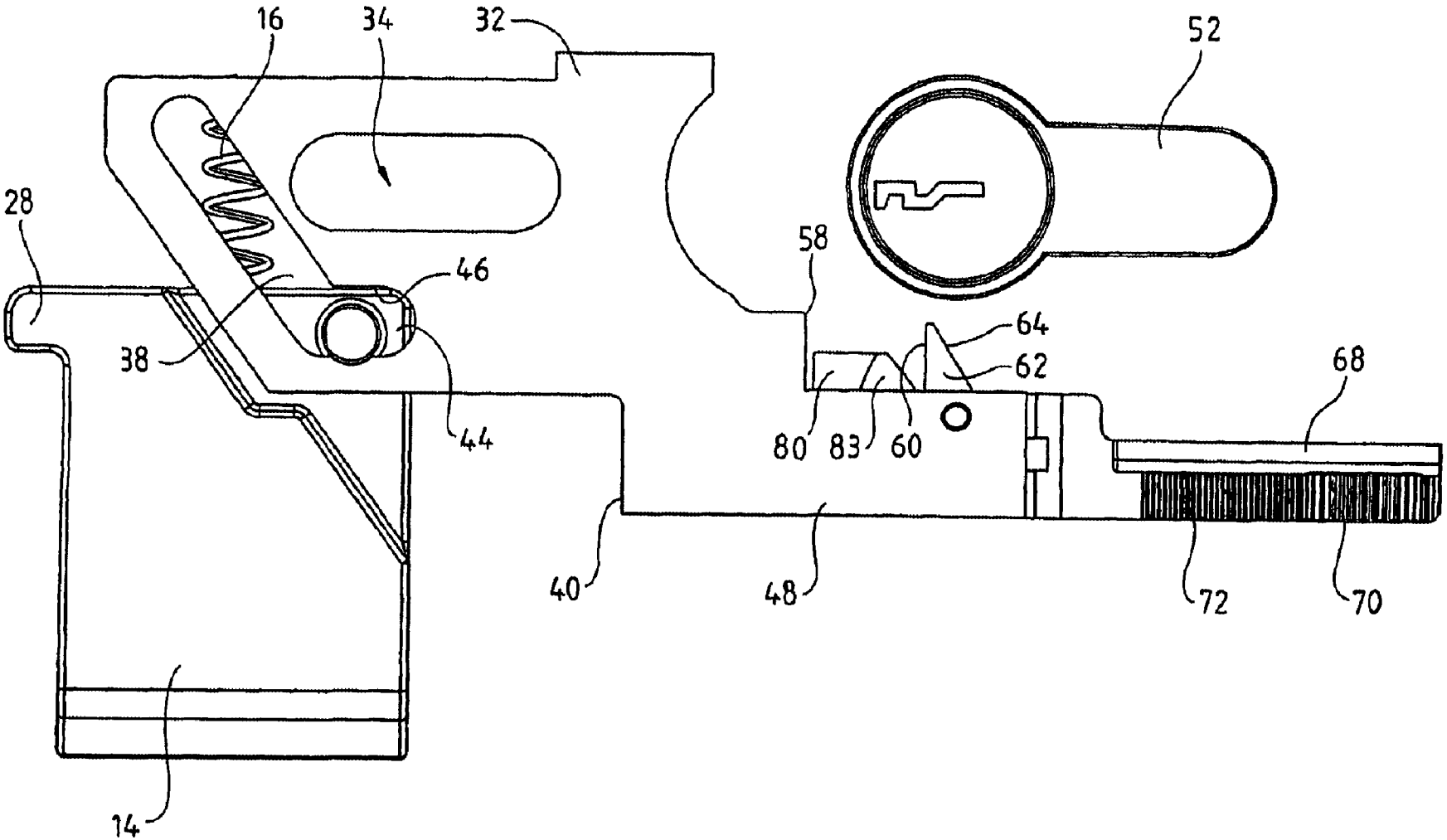
FIG. 4 is a cross-sectional view as in FIG. 3 but when the lock has been locked by the second activation means or the electric motor.
Figure 5A:
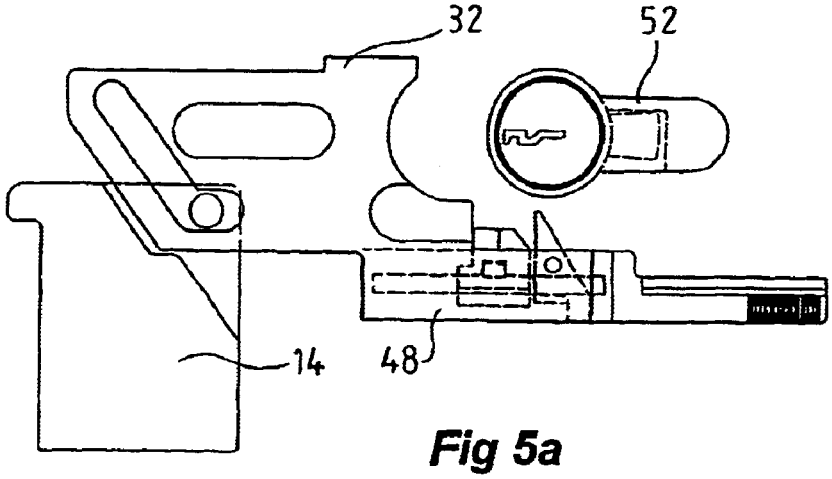
FIGS. 5(*a*) to (*l*) are progressive cross-sectional views of a lock according to the first embodiment wherein the second locking means being an electric motor has locked the lock and the first locking means that is key activated is used to decouple the electric motor from the lock slider and then unlock the lock.
Figure 5B:
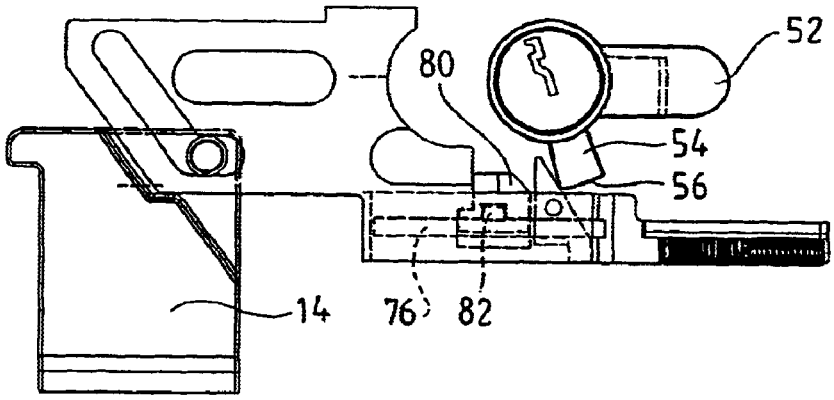
Figure 5C:
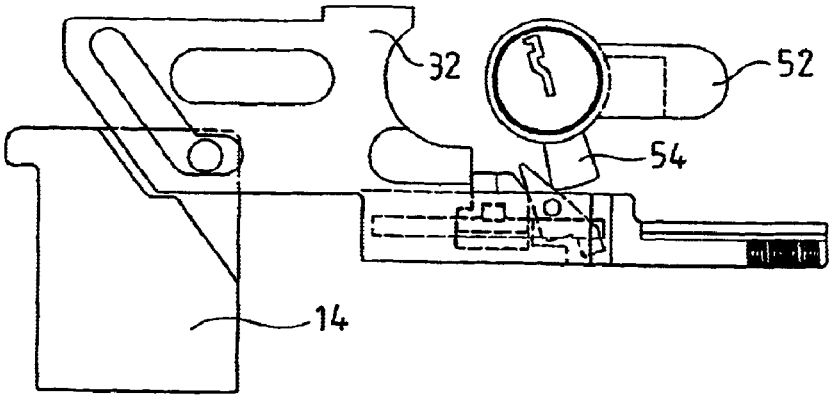
Figure 5D:
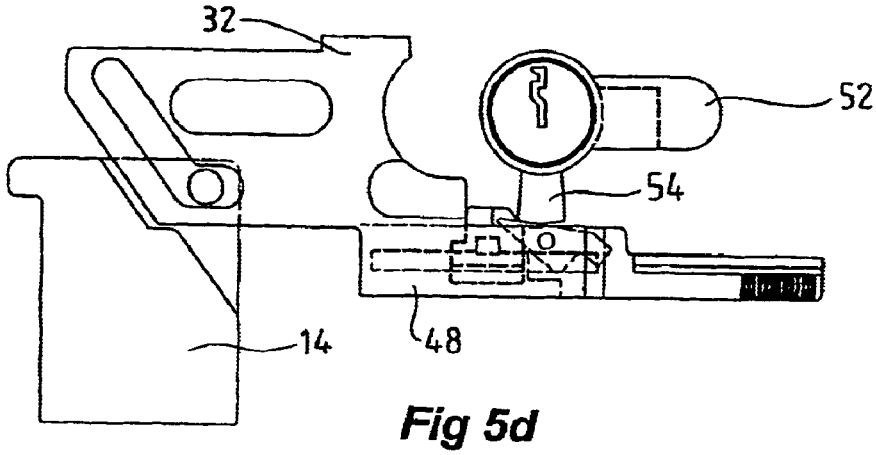
Figure 5E:
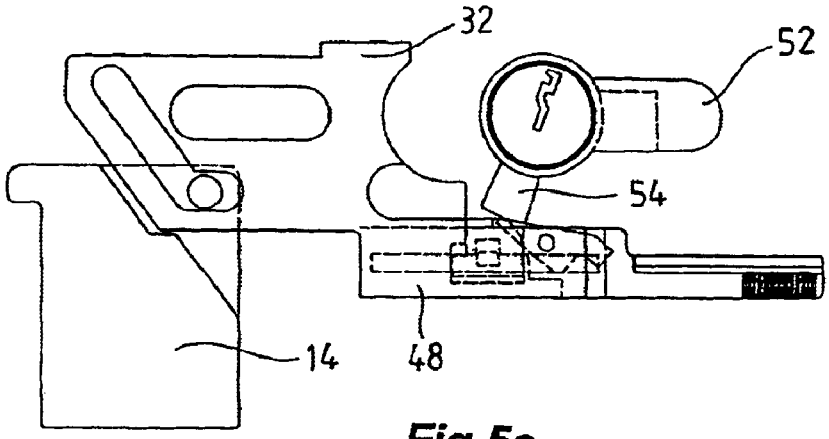
Figure 5F:
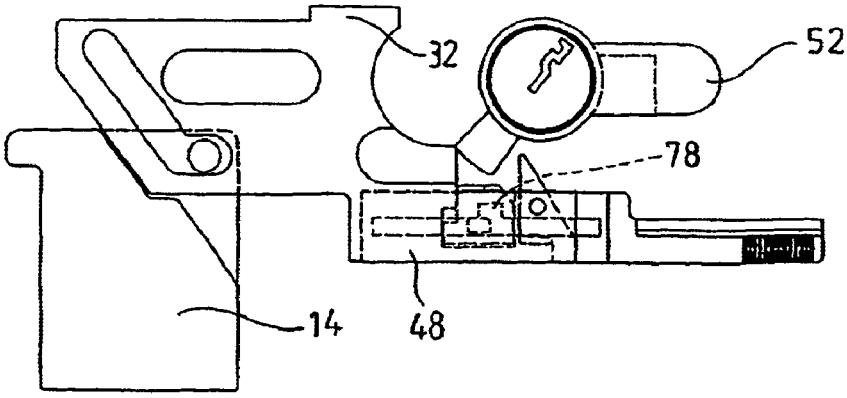
Figure 5G:
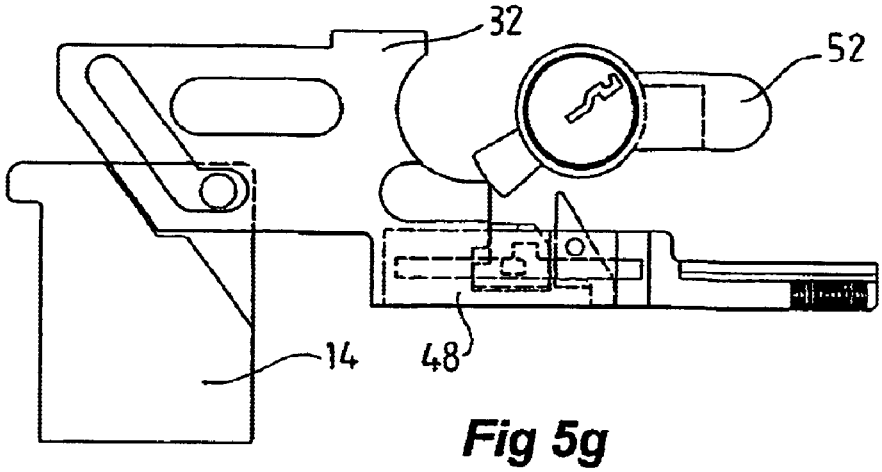
Figure 5H:
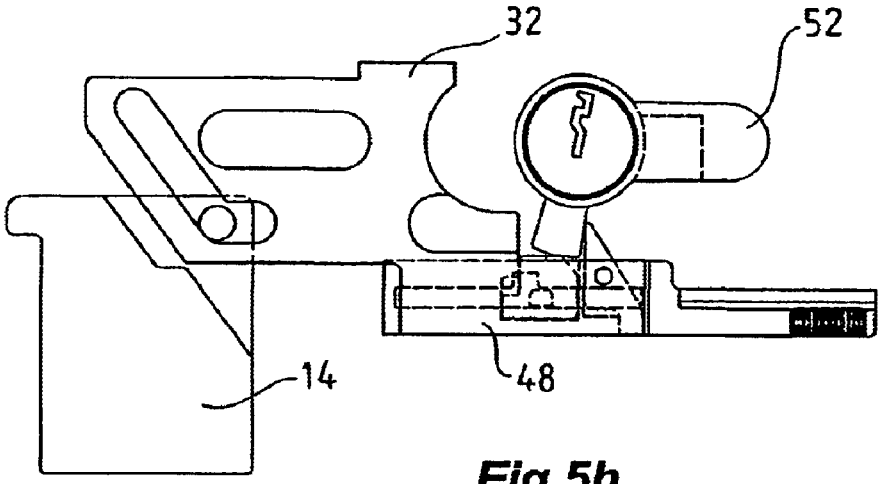
Figure 5I:
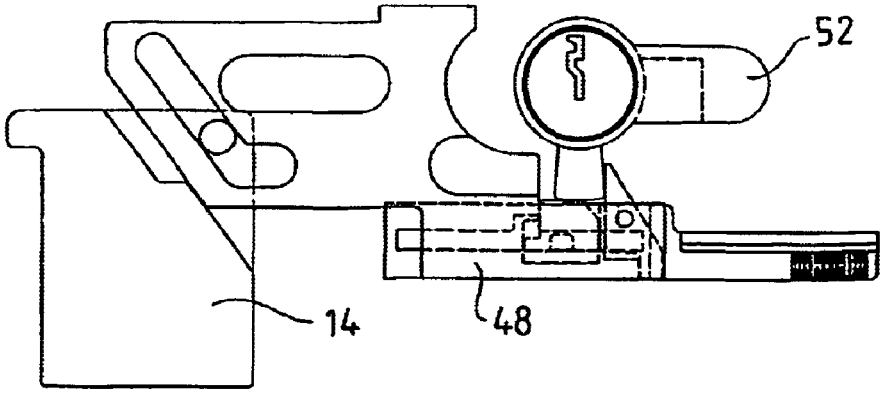
Figure 5J:
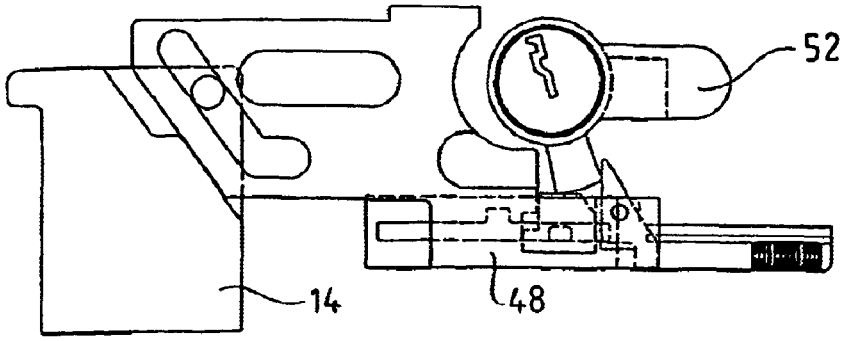
Figure 5K:
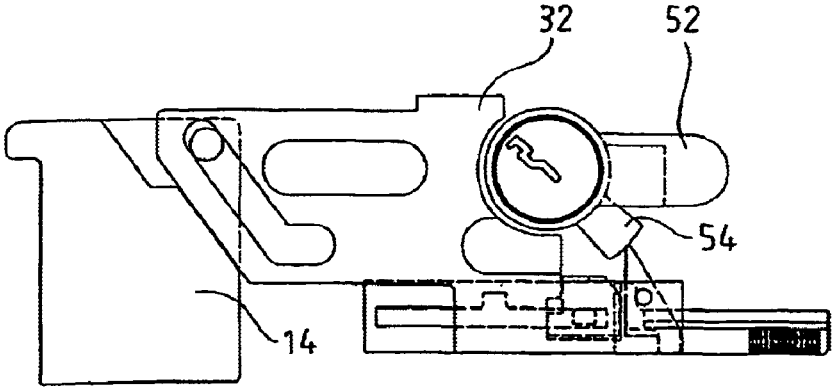
Figure 5L:
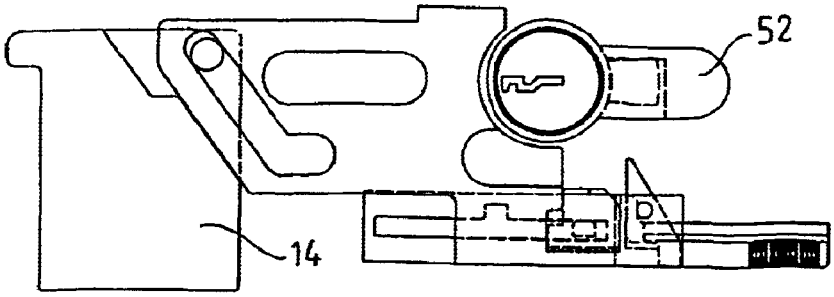

Illustrated in FIG. 3 is the lock arrangement when it is in an unlocked position. One can appreciate that both the cam and the rack are at their rest positions. To lock the door using the electric motor, one simply needs to run the motor so that the gear wheel engages with the splines. As illustrated in FIG. 4, when the motor has driven the splines the mechanical coupling of the rack to the slider through the plunger results in the bolt being in the locked position.

In the event that the lock arrangement has been locked or unlocked by the use of the electric motor, the primary locking means may be used to unlock or lock the locking arrangement as required. This is achieved as illustrated in FIGS. 5(*a*) to (*l*). The procedure is as follows:

Illustrated in FIG. 5(*a*) is the state of the lock arrangement when the electric motor has locked the lock. To unlock the lock using the cam, a key is used to rotate the cam until it abuts against the gate (FIG. 5(*b*)). From this position the gate is rotatable inwardly towards the cavity defined by the gate and slider and does so under further rotation of the cam (FIG. 5(*c*)). With further rotation still the cam moves slidably past the gate until it abuts the plunger. (FIG. 5(*d*)).

The plunger has a tapered surface where it contacts the cam and is thus caused to be depressed (FIG. 5(*e*)). Further rotation of the cam still results in it disengaging the gate that springs back into its biased position and causes the cam to engage the slider abutment surface whilst the plunger is still depressed (FIG. 5(*f*)). As the cam is rotated further still, it causes the plunger projection to move out of the recess of the slot whilst the slider moves away from the cam (FIG. 5(*g*)) until the cam rests against the corner of the slider. This is a deadlocked position and with the plunger projection disengaged from the rack even if the electric motor is used to move the rack it cannot move it sufficiently so as to enable the plunger projection to be urged into the recess.

To unlock the lock, the cam is rotated in the other direction until it abuts the gate. During this time the plunger is still depressed by the cam and thus there is no engagement of the slider with the rack (FIG. 5(*h*)). Further rotation of the cam still urges the slider rearwardly, this in turn causing the locking bolt to be retracted into the casing (FIGS. 5(*i*) and (*j*)), until the bolt has been fully retracted (FIG. 5(*k*)) and then the cam rotated back into its rest position (FIG. 5(*l*)).

One can thus appreciate how the present invention may be used to unlock a lock that has been locked by an electric motor that is still in the locked position. This is advantageous where the electric lock is to be over-ridden or where it has broken down. Use of the primary locking mechanism thus allows the lock to still operate even where the electric motor can no longer function.

Figure 6:
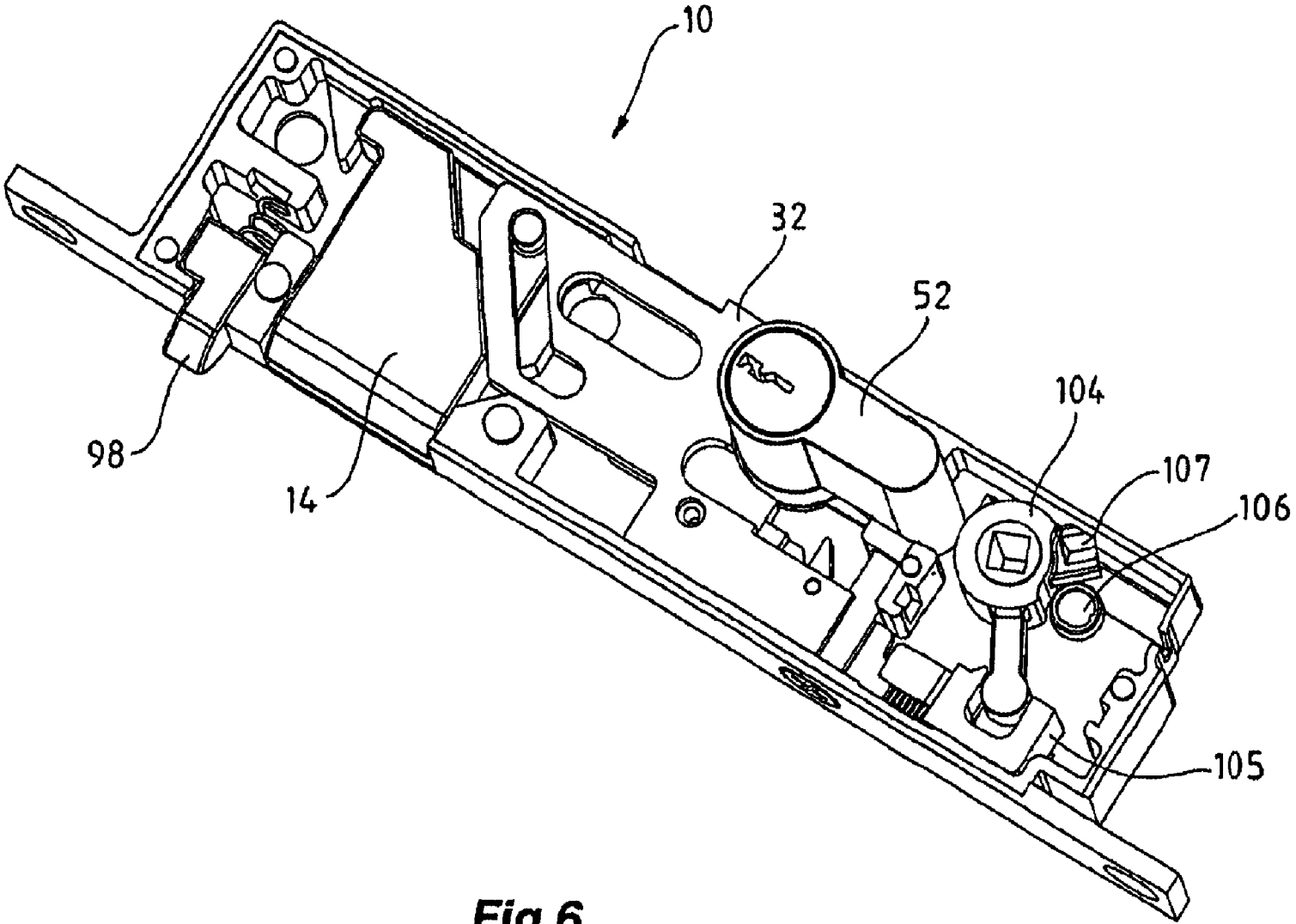
FIG. 6 is a perspective view of a second embodiment of the present invention where the second activation means is a manual activation means.
Figure 8:
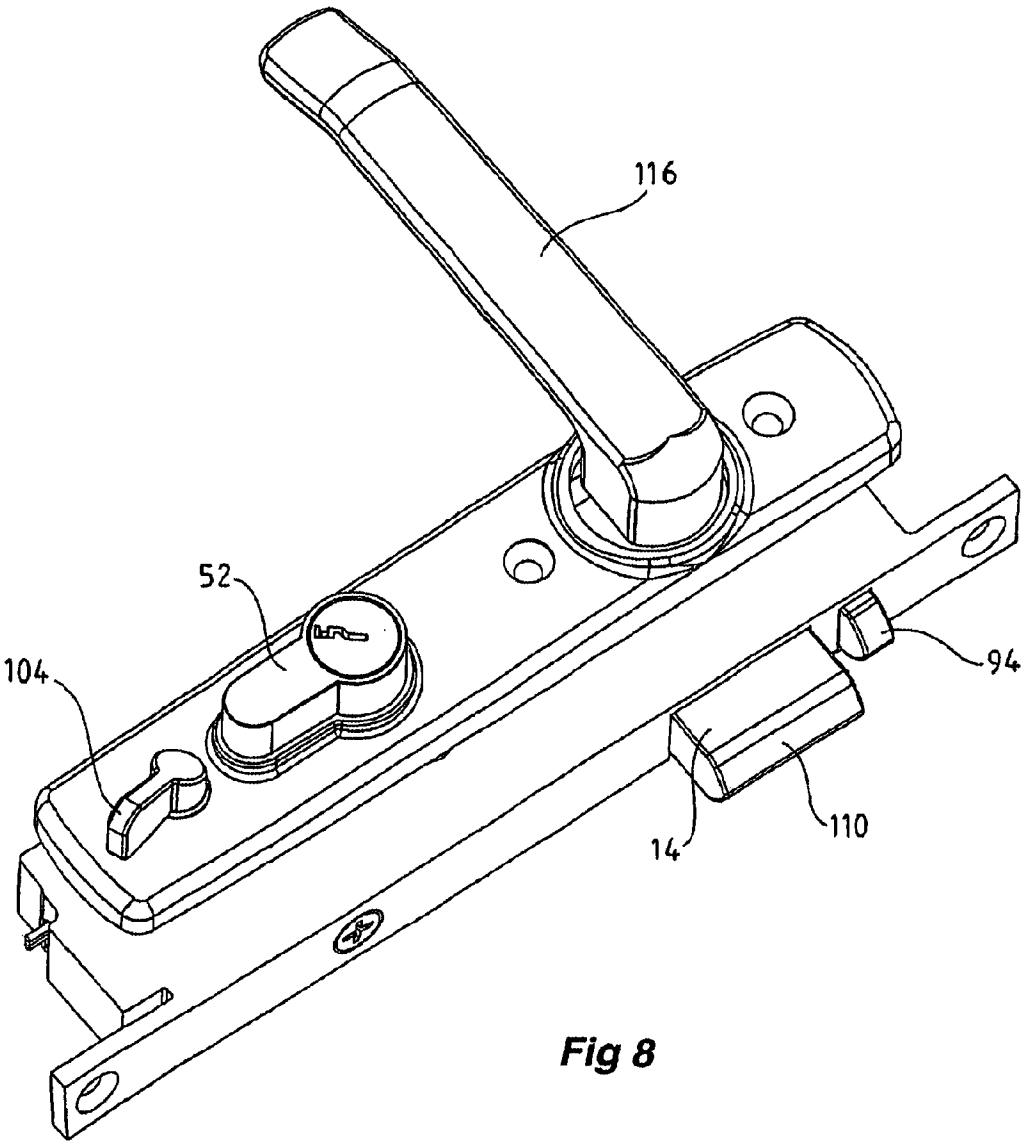
FIG. 8 is a perspective view of an assembled lock of FIG. 7.

It is to be understood that other secondary driving means may equally well be employed. As shown in FIGS. 6 and 8, the rack may be acted upon by use of a manually operate crank 104 that engages snib 105 fixed to the rack. Thus the snib may be used for example on the internal side of doors to provide for security and yet can be over-ridden by the use of a key that obviously may be used on both sides of the lock arrangement. Spring-loaded member 106 may be used for retention of the snib in its locked position when it interacts with shoulder 107.

Figure 7:
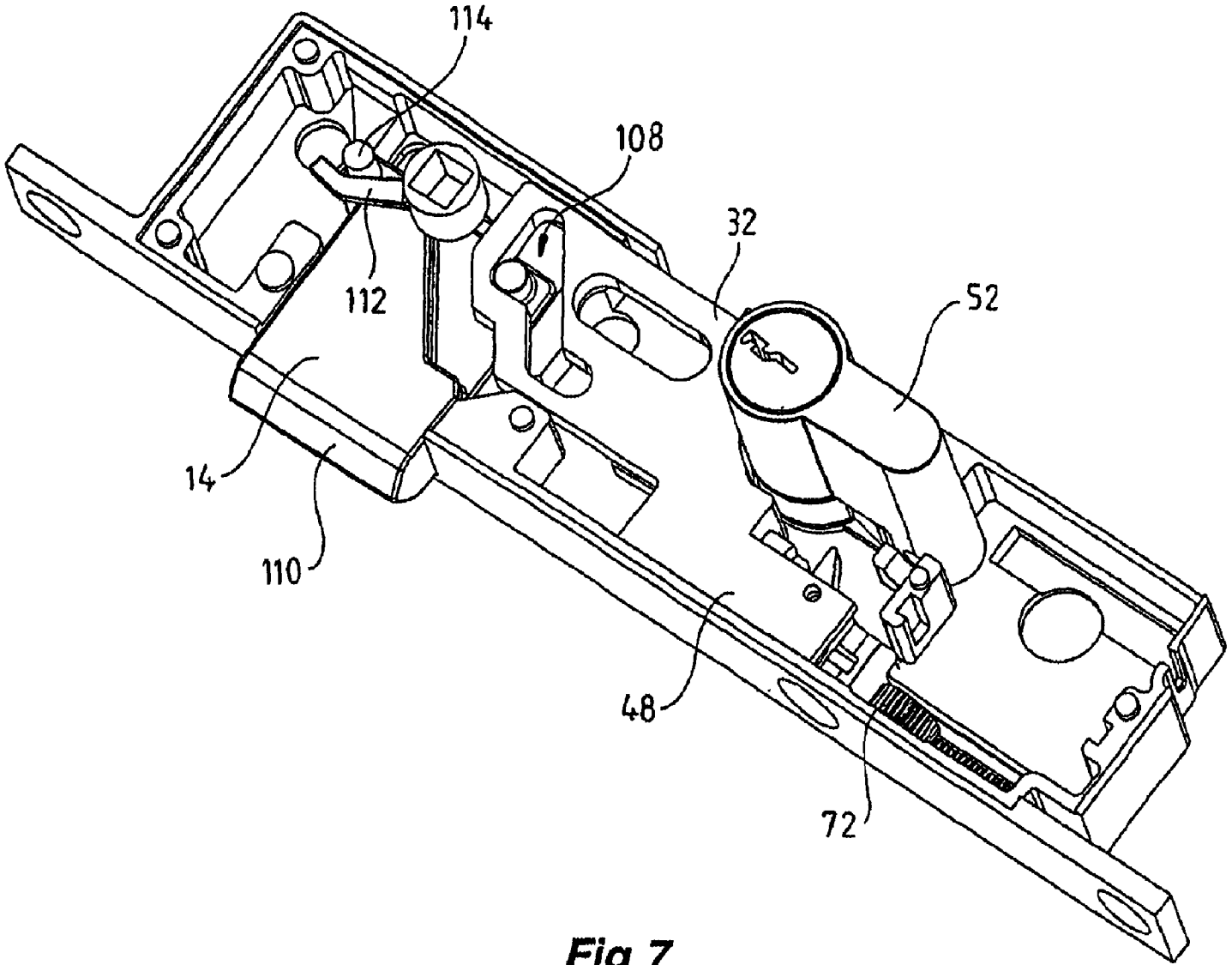
FIG. 7 is a perspective view of another embodiment of the present invention wherein the bolt may act as a latch.

In the description above, use was made of a latch 94 that assisted in keeping the door from swinging freely when the bolt is retracted but which still enables the door to be pulled open or simply closed by pushing. As shown in FIG. 7, the present invention may also accommodate this arrangement by modifying the slider and adding a handle acting on said bolt so that the latch is no longer required. In this embodiment, the slider slit has an additional cutout or recess 108 to accommodate the bolt projection 22. The location of recess 108 is chosen so that the tapered surfaces 110 of the bolt will engage a door strike. Thus when the tapered surface of the bolt impacts upon a door strike, the bolt will be urged inwardly into said casing until the biasing means meets no resistance and extends the bolt outwards.

When the bolt is in such a position, a lever 112 that engages a boss 114 on the rear side of the bolt and generally on top of projection 28 of the bolt is operated by handle 116.

Thus the use of this feature together with a bolt that has tapered faces enables for the bolt to act as a pseudo latch when it has been partially withdrawn from the door furniture.

Figure 9:
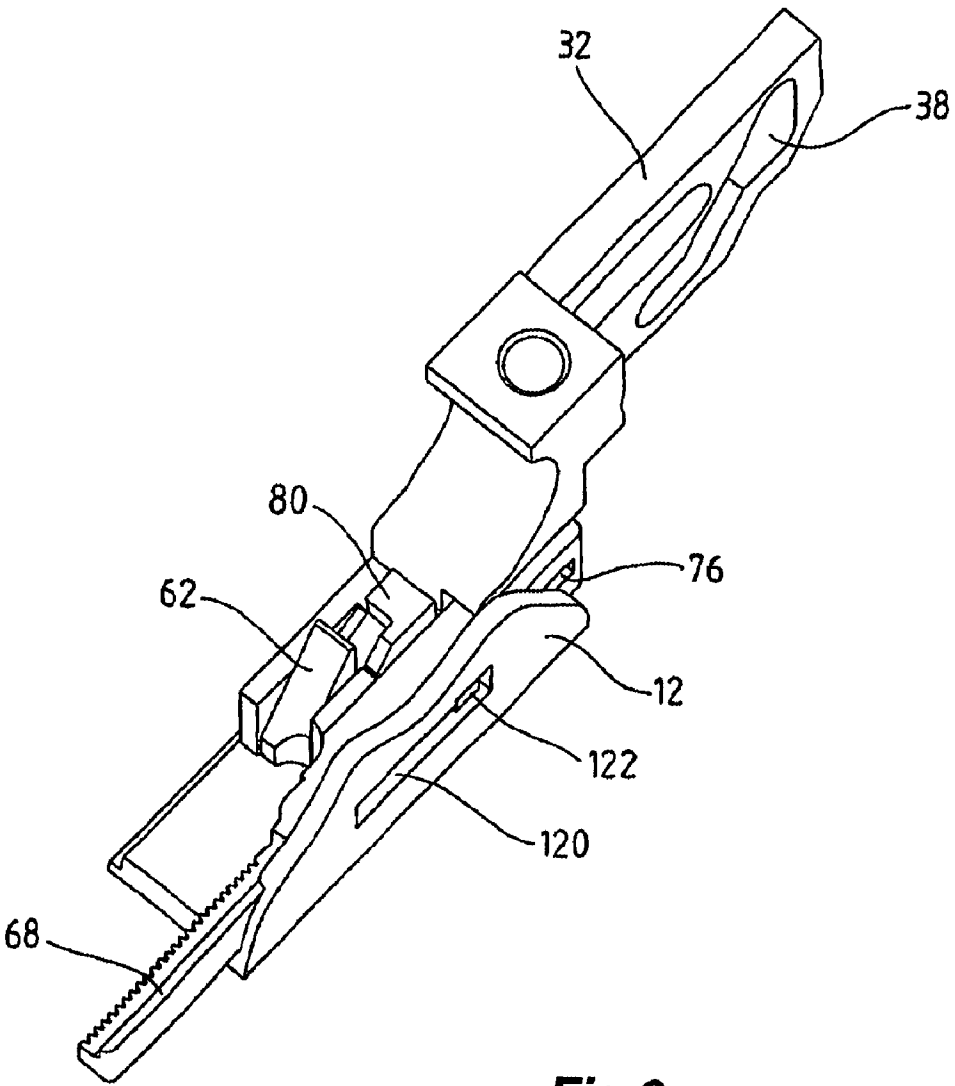
FIG. 9 is a perspective view of an embodiment of the invention wherein the lock may be deadlocked when locked by said electric motor.
Figure 10A:
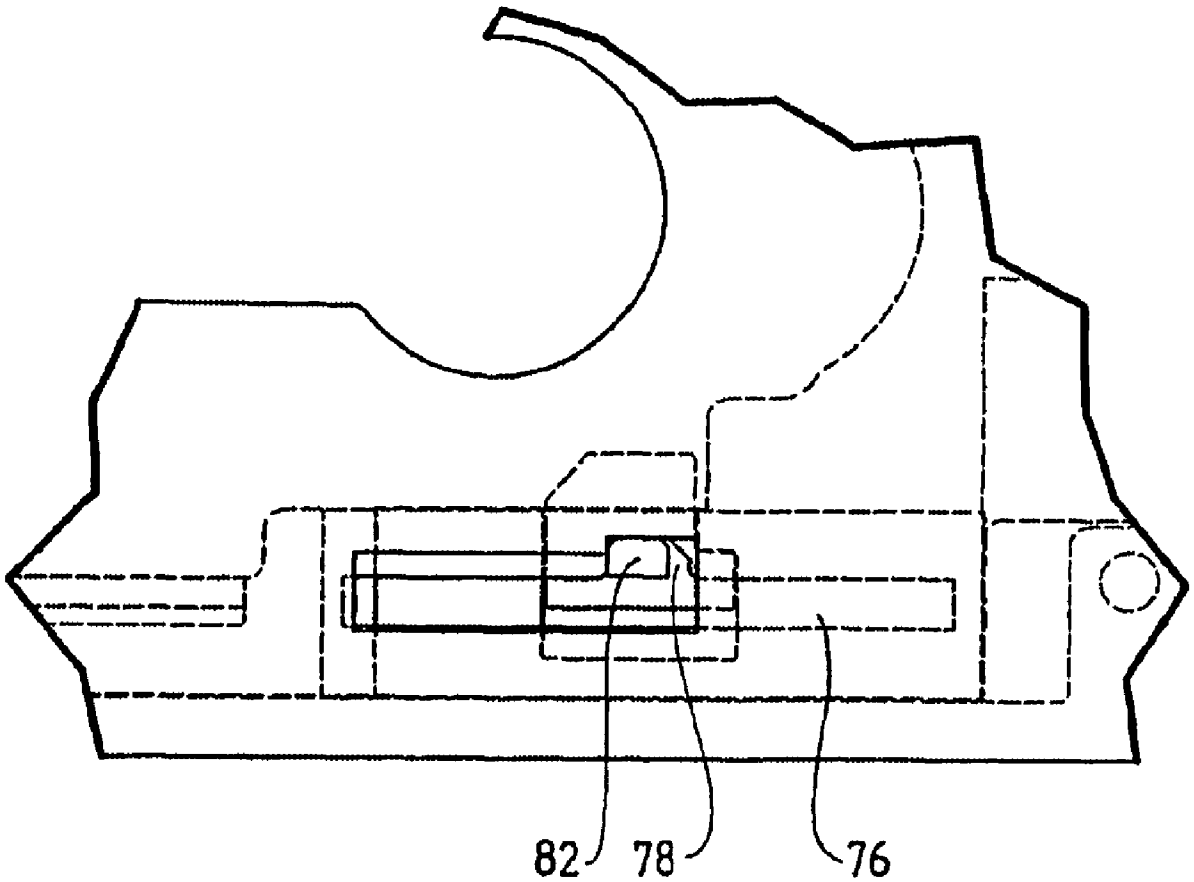
FIG. 10(*a*) to (*c*) is a progressive view of the deadlocking of FIG. 9 being disengaged.
Figure 10B:
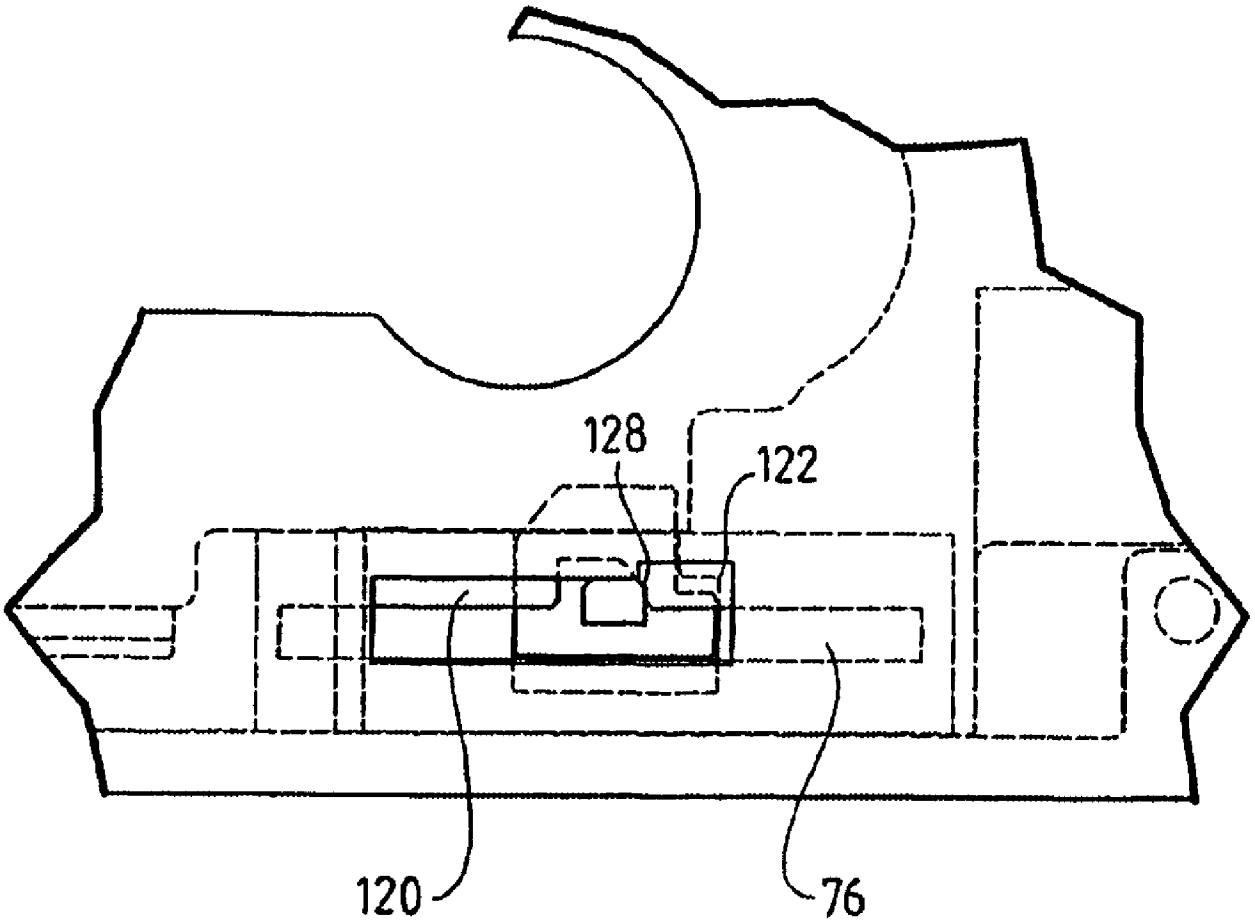
Figure 10C:
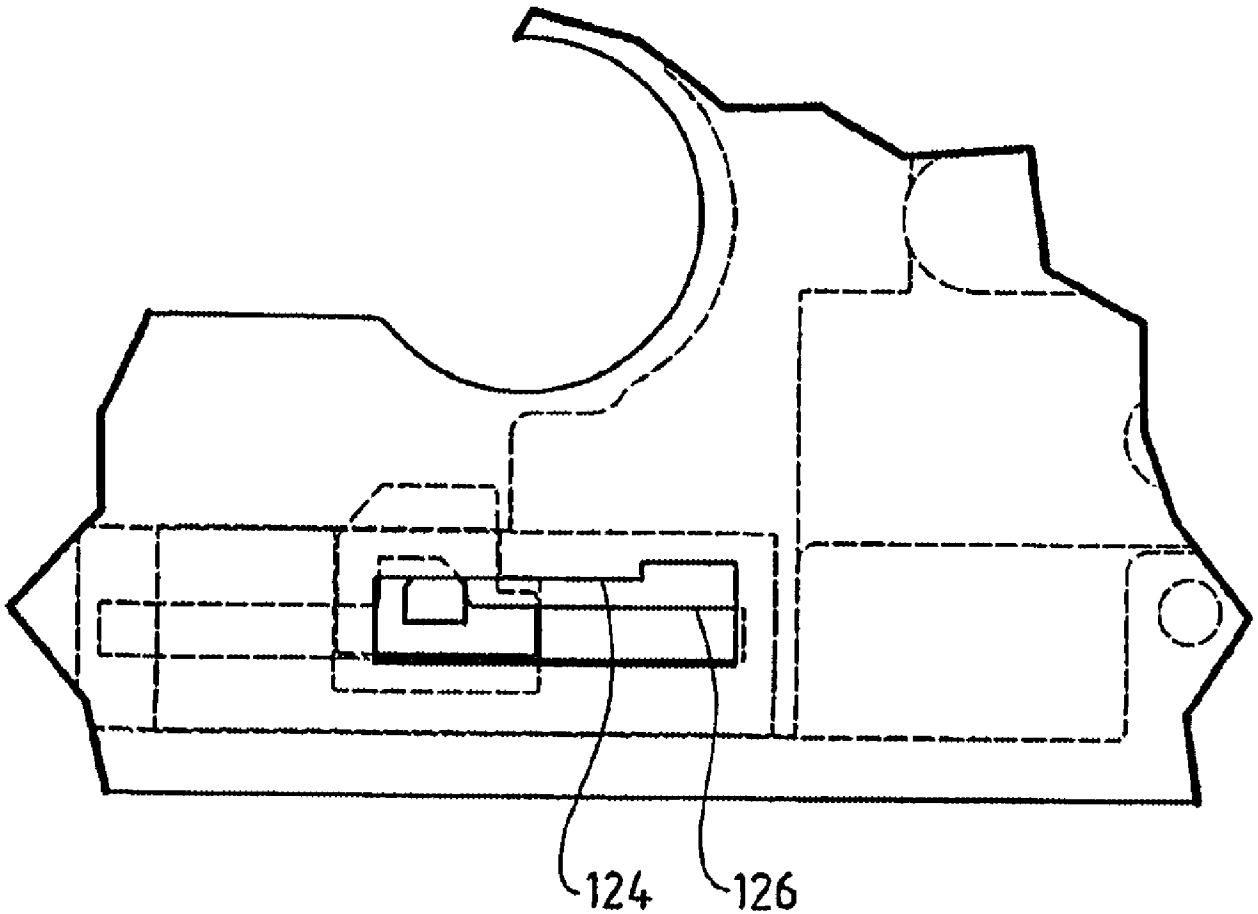

Referring now to FIGS. 9 and 10(*a*) to (*c*) there is shown an embodiment where the lock casing may be used to assist in deadlocking the lock when operated by the electric motor.

The lock casing 12 has a groove 120 having an upper recess 122. The upper recess 122 is adapted to be aligned with the cutout or recess 78 of the slot 76 in the rack. However, the projection is now generally smaller than the recess 78 so that the recess can move slightly without moving or acting on the projection when it is in the slot recess.

Whilst the upper edge of the groove recess and the slot recess are generally aligned, the upper edge of the groove is higher than the upper edge of the slot recess. Effectively this means that the depth of the recess of the groove is less than that of the slot and the projection may be moved out of the groove recess and still engage the slot recess.

This is clearly seen in FIGS. 10(*a*) to (*c*) as follows; after the electric motor has been used to lock the arrangement, shown in FIG. 10(*a*) the projection abuts high within the groove recess and the slot recess. When the electric motor begins to unlock the lock arrangement the slide is moved as shown in (*b*), the upper corner 128 of the slot recess, which is tapered, acts on the projection to impart a downward motion so as to move it out of the groove recess. The projection is then able to freely slide along the groove of the casing thereby not being deadlocked by it.

To enable the tapered surface 128 to act on the projection the width of the slot recess must be greater than the width of the projection. Otherwise, the projection would not have room to move downwards as the slot slides perpendicular to it.

In general the term deadlocking is intended to mean that when the lock is deadbolted, that the slider is effectively prevented from any slidable motion. In the case of being driven electrically, the deadlocking prevents any outside interference but the key activation or the electric motor may still unlock the lock. When the deadbolting has been achieved by use of the primary activation means, i.e. the key operated cam, then the deadlocking can only be effectively removed by use of the key and the electric activation cannot remove the deadlock.

The above description generally referred to the slider being movable by a key activating the primary locking mechanism and an electric servomotor driving the secondary locking mechanism. It may equally well be, however, that the secondary locking mechanism is also activated by the use of a solenoid. However the electric motor provides much higher torques required especially where the lock arrangement includes multiple bolts such as additional upper and lower bolts. Even further still the secondary locking mechanism may also include a key activated lock accessible from one or both sides of the lock case or other types of simple non-secure actuators.

Figure 11A:
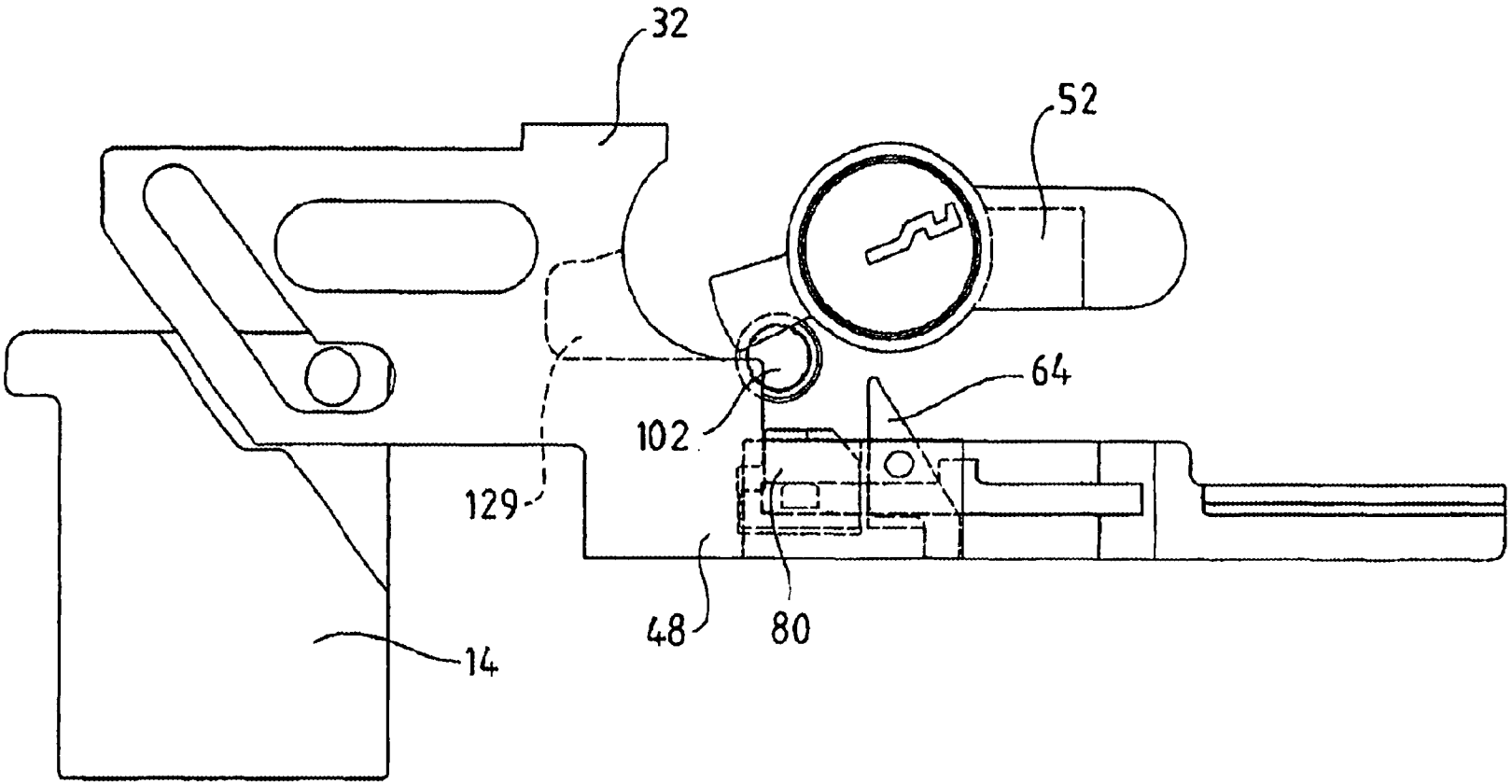
FIG. 11(*a*) to (*c*) represent cross-sectional views of a locking mechanism of an alternative embodiment a lock in accordance with the invention.
Figure 11B:
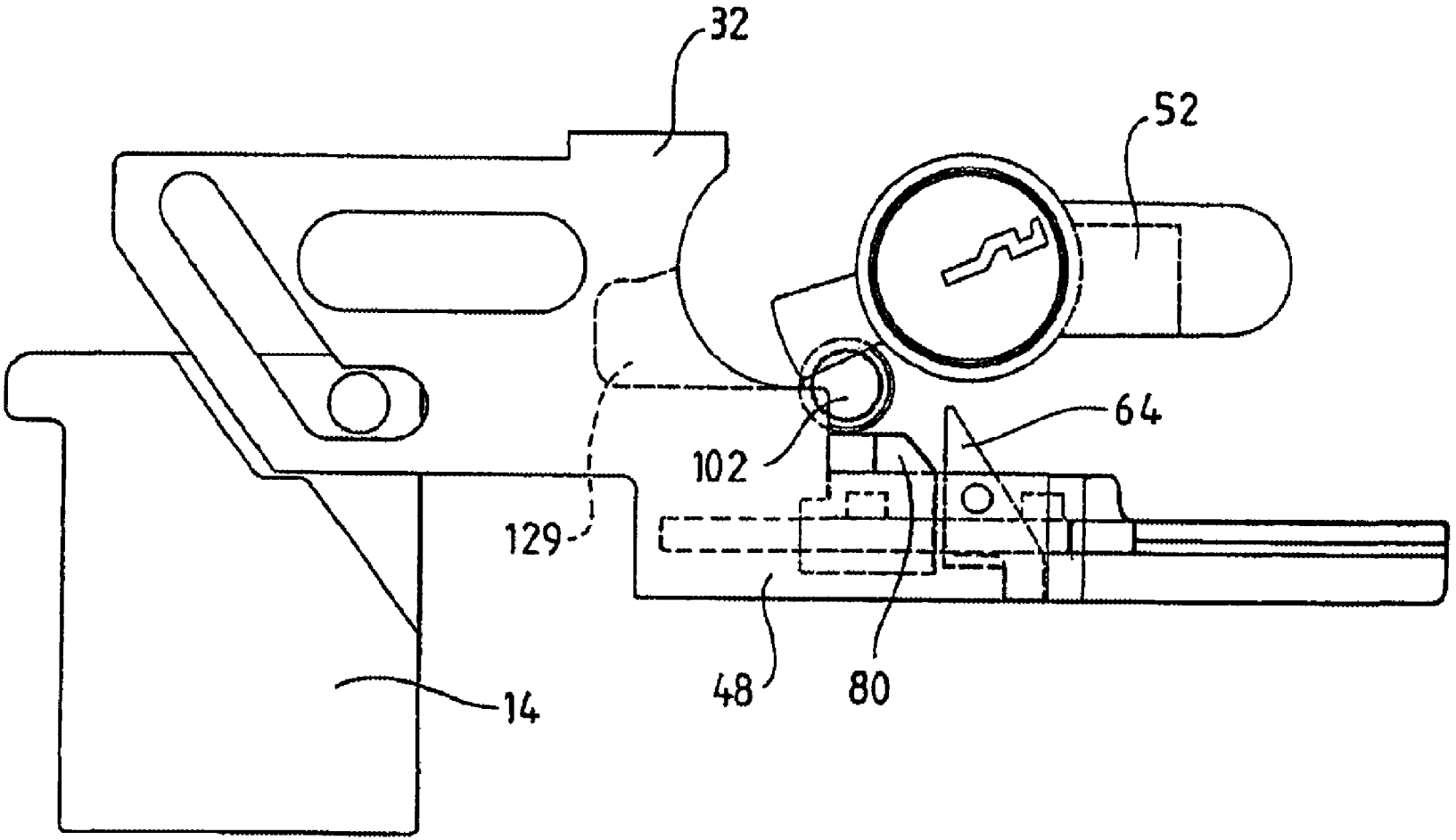
Figure 11C:
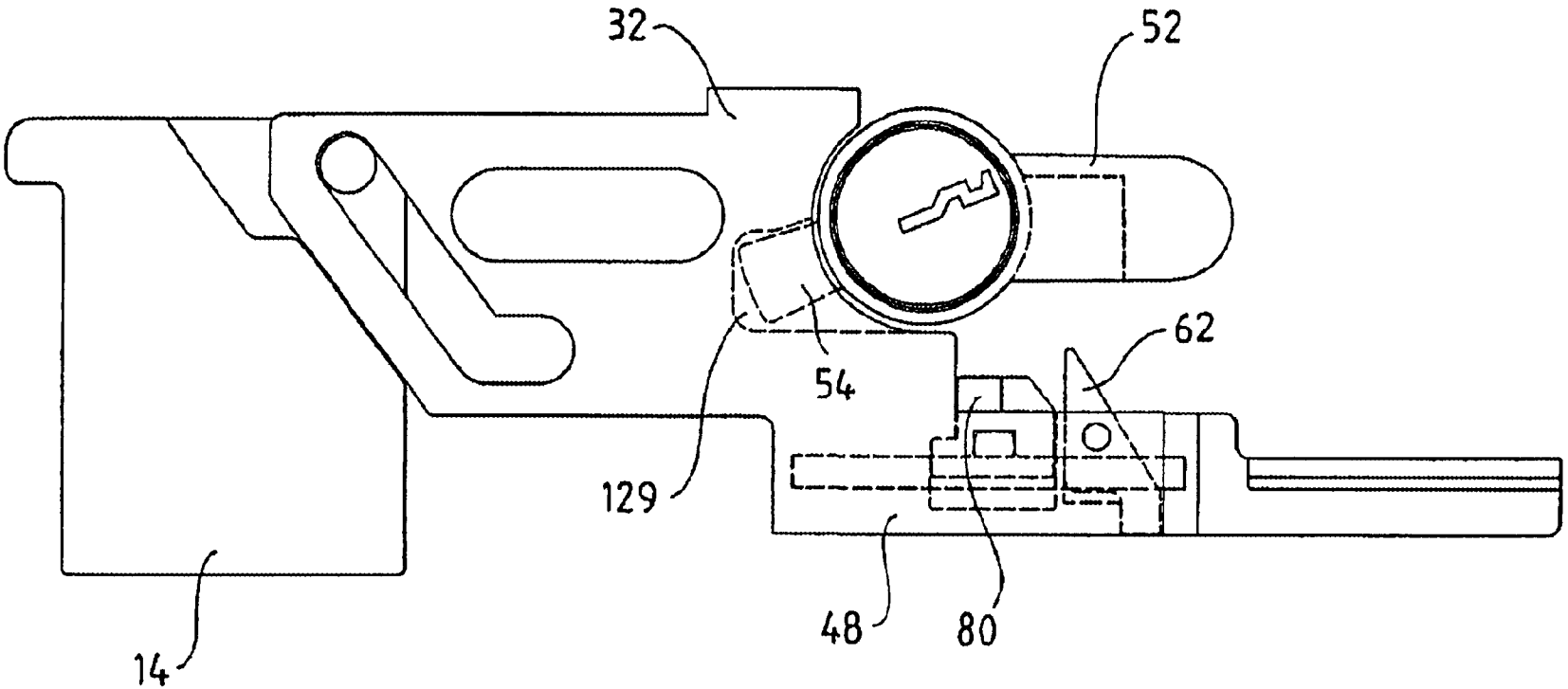

Referring to FIGS. 11(*a*) to 11(*c*) there is shown an embodiment where a lock may be unlocked by the electric motor after the lock has been locked by the primary means.

The slider includes a recess 129. This is shown in FIG. 11(*a*) where upon rotation of the key barrel to lock the lock, the slider and rack disengage and the cam aligns with the recess as it reaches the end of the locking operation and is no longer acting on the plunger.

Spring loaded bearing 102 retains the cam 54 in this position. Upon activation of the electric motor to unlock the lock, the rack moves toward the lock position and re-engages the slider when the plunger returns to the biased state as shown in FIG. 11(*b*). With the next activation of the electric motor, the slider is moved to the unlock position with the cam entering the recess, this illustrated in FIG. 11(*c*).

Other improvements may be made to the invention without deviating from its scope. For example the outside casing may include at least one slit 130 to allow for adjustment when retrofitting existing door members to avoid having to rework the door.

The present invention may also equally well be adapted for use on existing doors by the use of simple but effective adaptive pieces.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

What is claimed is:

1. A lock including:

a first drive means and a second drive means;

a slider which when in a first position locks said lock and when in a second position unlocks said lock;

said first drive means and second drive means adapted to move said slider between the first position and the second position, wherein operation of said first drive means to move said slider from the first to the second position causes said slider to disconnect from said second drive means, and whereby subsequent operation of said second drive means that would otherwise move the slider to the second position reconnects said second drive means and the slider to enable said second drive means to operate the lock;

wherein when said first drive means has locked said lock, said second drive means cannot unlock said lock;

wherein said first drive means is key operated;

wherein said second drive means is one of electrically operated, and key operated.

2. A lock including:

a first drive means and a second drive means;

a slider which when in a first position locks said lock and when in a second position unlocks said lock, said slider including at least two separable parts; wherein said slider is adapted to be acted on by said first and second drive means, wherein when said slider is acted upon by said second drive means said slider parts are cooperatively engaged to lock or unlock said lock; and wherein when said slider is acted upon by said first drive means, said slider separable parts are decoupled allowing said first drive means to engage said slider independent of said second drive means that then no longer operates said lock.

3. A lock as in claim 2 wherein when said first drive means has locked said lock, said second drive means cannot unlock said lock.

4. A lock as in claim 3 wherein said first drive means is key operated.

5. A lock as in claim 4 wherein said second drive means is electrically operated.

6. A lock as in claim 4 wherein said second drive means is key operated.

7. A lock arrangement including:

a casing and a locking bolt slidably supported by said casing and movable between at least first and second positions, in said first position extending outwardly from said casing to engage with an external restraining means and in said second position to be contained within said casing;

a slider located within the casing and adapted to interact with said locking bolt so as to move it into said first or second position;

said slider including at least a two-dimensional cavity defined at one side by an abutment surface and on the other side by a gate;

a first activation unit rotatably supported by said casing and having a cam adapted to rotate into said cavity; said cam when rotated in a first direction acting against the slider abutment surface and urging the slider towards a first position and thereby outwardly extending said bolt and when said cam is rotated in an opposite direction it engages said slider gate to urge the slider towards a second position to thereby inwardly retract said bolt;

said cam able to enter said cavity independent of the position of said slider by said gate allowing said cam to enter said cavity through said gate but not to exit it until the slider has been moved sufficiently towards its second position where the path swept by said cam does not intersect said gate; and a second activation unit adapted to move the slider between its first and second positions.

8. A lock arrangement as in claim 7, wherein said second activation unit engages with said slider through a clutch arrangement.

9. A lock arrangement as in claim 8 wherein said second activation unit includes an electric motor that engages said slider by a rack having a slit and a recess, the mechanical coupling of the slider with the rack achieved by a plunger fixedly attached to said slider and having a projection correspondingly dimensioned to said recess, said plunger movable between a first and a second position, in said first position said projection engaging with said recess to thereby effectively mechanically couple said second activation unit to said slider and thus the bolt and in said second position said projection entering into the slit within which it may slidably move to thereby effectively decouple said second activation unit from the slider.

10. A lock arrangement as in claim 9 wherein when said cam has entered said cavity it causes movement of said plunger into said second position where the second activation means is decoupled from the slider.

11. A lock arrangement as in claim 10 wherein when said slider interacts with said locking bolt so as to move said bolt into its first position said slider resists withdrawal of said locking bolt.

* * * * *